US008457335B2

(12) United States Patent
Imamura et al.

(10) Patent No.: US 8,457,335 B2
(45) Date of Patent: Jun. 4, 2013

(54) ENVIRONMENT ADAPTIVE TYPE HEARING AID

(75) Inventors: Yasushi Imamura, Ehime (JP); Yasushi Ueda, Ehime (JP); Nobuaki Noguchi, Ehime (JP); Hirotaka Ochi, Ehime (JP); Ichiro Kuwabara, Ehime (JP)

(73) Assignee: Panasonic Corporation, Osaka (JP)

( * ) Notice: Subject to any disclaimer, the term of this patent is extended or adjusted under 35 U.S.C. 154(b) by 461 days.

(21) Appl. No.: 12/665,986

(22) PCT Filed: Jun. 25, 2008

(86) PCT No.: PCT/JP2008/001657
§ 371 (c)(1),
(2), (4) Date: Dec. 22, 2009

(87) PCT Pub. No.: WO2009/001559
PCT Pub. Date: Dec. 31, 2008

(65) Prior Publication Data

US 2010/0189293 A1 Jul. 29, 2010

(30) Foreign Application Priority Data

Jun. 28, 2007 (JP) ..... 2007-169939

(51) Int. Cl.
*H04R 25/00* (2006.01)

(52) U.S. Cl.
USPC ..... 381/317; 381/312; 381/57

(58) Field of Classification Search
USPC ..... 381/312, 314, 315, 317, 320, 56, 381/57
See application file for complete search history.

(56) References Cited

U.S. PATENT DOCUMENTS 5,479,522 A * 12/1995 Lindemann et al. ..... 381/23.1
5,687,241 A * 11/1997 Ludvigsen ..... 381/312

(Continued)

FOREIGN PATENT DOCUMENTS

EP 732036 B1 * 5/1997
JP 06-105399 B 4/1994

(Continued)

OTHER PUBLICATIONS

International Search Report of PCT Application No. PCT/JP2008/001657 dated Oct. 14, 2008.

*Primary Examiner* — Vivian Chin
*Assistant Examiner* — Con P Tran
(74) *Attorney, Agent, or Firm* — Panasonic Patent Center

(57) ABSTRACT

There is provided an environment adaptive type hearing aid capable of reducing the erroneous estimation of an ambient environment or the unnecessary changeover of a hearing aid process. The environment adaptive type hearing aid includes an input section (110) that inputs an ambient sound, a scheduled environment referring section (180) having a scheduled environment table (270) to store a scheduled environment candidate corresponding to an ambient environment other than the ambient sound set in advance for the hearing aid, an environment estimating section (200) that estimates an ambient environment candidate of the hearing aid on the basis of the ambient sound and estimates an estimation ambient environment on the basis of the ambient environment candidate and the scheduled ambient environment candidate, a hearing ability compensation system determining section (220) that determines a compensation system for the hearing aid on the basis of the estimation ambient environment, a hearing ability compensating section (130) that processes the ambient sound on the basis of the determined compensation system, and an output section (150) that outputs the processed ambient sound as an output sound.

20 Claims, 9 Drawing Sheets

U.S. PATENT DOCUMENTS

| | | | | |
|---|---|---|---|---|
| 6,330,339 | B1 * | 12/2001 | Ishige et al. | 381/312 |
| 6,870,940 | B2 * | 3/2005 | Meyer et al. | 381/314 |
| 7,653,205 | B2 * | 1/2010 | Allegro Baumann et al. | 381/313 |
| 7,853,030 | B2 * | 12/2010 | Grasbon et al. | 381/314 |
| 2002/0123329 | A1 * | 9/2002 | Murray | 455/414 |
| 2003/0144838 | A1 * | 7/2003 | Allegro | 704/233 |
| 2005/0129262 | A1 | 6/2005 | Dillon et al. | |
| 2006/0204025 | A1 | 9/2006 | Paludan-Muller | |
| 2007/0269053 | A1 * | 11/2007 | Meier et al. | 381/74 |

FOREIGN PATENT DOCUMENTS

| | | |
|---|---|---|
| JP | 9-182193 | 7/1997 |
| JP | 2003-264892 | 9/2003 |
| JP | 2005-203981 | 7/2005 |
| JP | 2005-531175 A | 10/2005 |
| JP | 2007-512717 A | 5/2007 |
| JP | 2007-142701 | 6/2007 |

* cited by examiner

ENVIRONMENT ADAPTIVE TYPE HEARING AID

CROSS-REFERENCE TO RELATED APPLICATIONS

This is a U.S. National Phase Application under 35 U.S.C. Section 371 of PCT/JP2008/001657, filed on Jun. 25, 2008, which claims priority under 35 U.S.C. Section 119(a) to Japanese Patent Application No. 2007-169939 filed in Japan on Jun. 28, 2007, the entire contents of which are incorporated herein by reference.

TECHNICAL FIELD

The present invention relates to hearing aids, and more particularly, to a technology for automatically switching a hearing ability compensation system of an output signal.

BACKGROUND ART

Recent hearing aids compress an input sound in accordance with a dynamic range of a hearing aid user by a digital signal process to output the compressed sound. That is, a comfortable sound is output to the hearing aid user by amplifying a small sound and decreasing a large sound. Since the sound articulation may be degraded or the uncomfortable feeling may be increased when the ambient environment noise is simultaneously amplified along with the sound, a hearing ability compensation system is changed in correspondence with the influence of ambient environment noise so as to increase an SN ratio as a ratio of a signal (sound) and noise (environment sound).

An environment adaptive type hearing aid of the related art is characterized in that a compensation method selecting section is provided to extract various feature quantities based on an input signal acquired from at least one microphone of the hearing aid so as to change a hearing ability compensation system in correspondence with the influence of ambient environment noise, compare the feature quantities with pre-registered standard patterns, select a standard pattern having the largest similarity with the input signal, and select a compensation method from a reference table in which each standard pattern is associated with a hearing compensation method (for example, see Patent Reference 1).

Patent Reference 1: JP-A-6-105399

DISCLOSURE OF INVENTION

Technical Problem

However, the configuration of the related art has a problem in that a hearing ability compensation system unintended by the hearing aid user may be selected by erroneously estimating an ambient environment or a hearing aid process may be unnecessarily switched when the feature quantities extracted from the input signal are similar to each other or in the ambient environment where the ambient sound varies from time to time since the ambient environment estimation depends upon the input signal from the microphone.

The present invention has been made to solve the problem of the related art, and an object of the invention is to provide an environment adaptive type hearing aid capable of improving the accuracy of estimating ambient environments.

Technical Solution

According to the present invention, there is an environment adaptive type hearing aid for generating an output sound from an ambient sound, including: an input section that inputs the ambient sound; a predicted environment referring section having a prediction ambient environment table to store a predicted ambient environment candidate corresponding to an ambient environment other than the ambient sound set in advance for the hearing aid; an environment estimating section that estimates an ambient environment candidate of the hearing aid on the basis of the ambient sound input by the input section and estimates an estimation ambient environment on the basis of the ambient environment candidate and the predicted ambient environment candidate; a hearing ability compensation system determining section that determines a compensation system for the hearing aid on the basis of the estimation ambient environment estimated by the environment estimating section; a hearing ability compensating section that processes the ambient sound input by the input section on the basis of the compensation system determined by the hearing ability compensating system determining section; and an output section that outputs the ambient sound processed by the hearing ability compensating section as the output sound.

By this configuration, it is possible to improve the accuracy of estimating ambient environments by presetting prediction information (information corresponding to ambient environments other than an ambient sound) for predicting ambient environments, and adjusting an ambient environment estimated on the basis of the input ambient sound by the prediction information.

The environment adaptive type hearing aid of the present invention includes: a time acquiring section that acquires a present time, wherein the predicted environment referring section stores a predetermined time band and a predicted ambient environment candidate corresponding to the predetermined time band in the predicted ambient environment table, and wherein the environment estimating section estimates the estimation ambient environment on the basis of the ambient environment candidate and the predicted ambient environment candidate corresponding to the present time acquired by the time acquiring section.

By this configuration, prediction information is set as information corresponding to a time, thereby improving the accuracy of estimating ambient environments by the time.

In the environment adaptive type hearing aid of the present invention, the predicted environment referring section includes: a movement speed calculating section that calculates a movement speed on the basis of a variation quantity of a present location of the hearing aid, wherein the predicted ambient environment table stores a predetermined speed and a predicted ambient environment candidate corresponding to the predetermined speed, and wherein the environment estimating section estimates the estimation ambient environment on the basis of the ambient environment candidate, the predicted ambient environment candidate corresponding to the present time acquired by the time acquiring section, and the predicted ambient environment candidate corresponding to the movement speed calculated by the movement speed calculating section.

By this configuration, prediction information is set as information corresponding to a time and a movement speed of the hearing aid, thereby improving the accuracy of estimating ambient environments by the time and the speed.

The environment adaptive type hearing aid of the present invention includes: a present location acquiring section that acquires a present location of the hearing aid, wherein the predicted environment referring section stores a predetermined region and a predicted ambient environment candidate corresponding to the predetermined region in the predicted ambient environment table, and wherein the environment estimating section estimates the estimation ambient environment on the basis of the ambient environment candidate and the predicted ambient environment candidate corresponding to the present location acquired by the present location acquiring section.

By this configuration, prediction information is set as information corresponding to a present location, thereby improving the accuracy of estimating ambient environments by a region.

In the environment adaptive type hearing aid of the present invention, the predicted environment referring section includes: a movement speed calculating section that calculates a movement speed on the basis of a variation quantity of a present location of the hearing aid acquired by the present location acquiring section, wherein the predicted ambient environment table stores a predetermined speed and a predicted ambient environment candidate corresponding to the predetermined speed, and wherein the environment estimating section estimates the estimation ambient environment on the basis of the ambient environment candidate, the predicted ambient environment candidate corresponding to the present location acquired by the present location acquiring section, and the predicted ambient environment candidate corresponding to the movement speed calculated by the movement speed calculating section.

By this configuration, prediction information is set as information corresponding to a present location and a movement speed of the hearing aid, thereby improving the accuracy of estimating ambient environments by the region and the speed.

The environment adaptive type hearing aid of the present invention includes: a time acquiring section that acquires a present time; a present location acquiring section that acquires a present location of the hearing aid; and a predicted environment selecting section that selects at least one predicted ambient environment candidate from a plurality of predicted ambient environment candidates stored in the predicted ambient environment table, wherein the predicted environment referring section includes: a movement speed calculating section that calculates a movement speed on the basis of a variation quantity of a present location of the hearing aid acquired by the present location acquiring section, wherein the predicted ambient environment table stores a predetermined time band and a predicted ambient environment candidate corresponding to the predetermined time band, a predetermined region and a predicted ambient environment candidate corresponding to the predetermined region, and a predetermined speed and a predicted ambient environment candidate corresponding to the predetermined speed, and wherein the environment estimating section estimates the estimation ambient environment on the basis of the ambient environment candidate and the predicted ambient environment candidate selected by the predicted environment selecting section.

By this configuration, prediction information is set as information corresponding to a time, a present location, and a speed of the hearing aid, thereby improving the accuracy of estimating ambient environments by at least one of the time, the region, and the speed. This further improves the accuracy of estimating ambient environments.

In the environment adaptive type hearing aid of the present invention, the time acquiring section acquires a present time by communicating with a device having a clock function outside the hearing aid.

By this configuration, the hearing aid itself may not have a clock function, and it is possible to miniaturize the hearing aid or reduce a processing load.

In the environment adaptive type hearing aid of the present invention, the predicted environment referring section includes: a predicted environment setting section that sets the predicted ambient environment candidate in the predicted ambient environment table by communicating with a device outside the hearing aid; and a scheduled environment searching section that searches for a predicted ambient environment candidate corresponding to a predetermined condition from the predicted ambient environment table.

By this configuration, it is possible to preset prediction information for predicting ambient environments, and it is possible to improve the accuracy of estimating ambient environments by using the prediction information.

In the environment adaptive type hearing aid of the present invention, the environment estimating section includes: a feature quantity calculating section that calculates a feature quantity from the input signal based on the ambient sound input by the input section; a similarity level calculating section that calculates a similarity level of each ambient environment candidate stored in an ambient environment table on the basis of the feature quantity; and an estimation environment output section that makes a comparison with a magnitude of the similarity level of each ambient environment candidate and determines the estimation ambient environment.

By this configuration, it is possible to improve the accuracy of estimating ambient environments since an estimation ambient environment is determined on the basis of a similarity level of each ambient environment candidate.

In the environment adaptive type hearing aid of the present invention, the estimation environment output section changes a time interval at which the estimation ambient environment is estimated on the basis of whether or not the determined estimation ambient environment matches the predicted ambient environment candidate corresponding to a predetermined condition.

By this configuration, it is possible to reduce a processing load of the hearing aid by decreasing the estimation frequency of an ambient environment when the hearing aid is located in a predicted ambient environment.

In the environment adaptive type hearing aid of the present invention, the estimation environment output section switches whether or not to consider the scheduled ambient environment candidate when estimating the ambient environment.

By this configuration, for example, it is unnecessary to adjust a similar estimation ambient environment candidate a number of times when a sound-signal average sound pressure level is constant, and it is possible to reduce a processing load of the hearing aid.

In the environment adaptive type hearing aid of the present invention, when a sound-signal average sound pressure level of the input signal is equal to or greater than a predetermined threshold value, the estimation environment output section estimates an ambient environment candidate having a gain which is equal to or less than a predetermined value in the hearing ability compensating section as the estimation ambient environment.

By this configuration, for example, it is possible to prevent a sound from being amplified more than necessary when a sound-signal average sound pressure level is greater than a predetermined value.

In the environment adaptive type hearing aid of the present invention, the feature quantity calculating section extracts a sound-signal average sound pressure level of the input signal, a noise-signal average sound pressure level, a sound signal duration time, and a noise signal duration time as the feature quantity.

By this configuration, for example, it is possible to assume an ambient environment such as "Office Work", "Noisy Conversation", "Quiet", "Conversation", or the like.

In the environment adaptive type hearing aid of the present invention, the similarity level calculating section sets the similarity level by accumulating a square of a difference between a feature quantity value and a predetermined value in an ambient environment candidate stored in the ambient environment table for every feature quantity.

By this configuration, it is possible to calculate a similarity level at which a difference between feature quantities is emphasized and it is possible to improve the accuracy of estimating ambient environments.

In the environment adaptive type hearing aid of the present invention, the estimation environment output section assigns a weight to a similarity level of the ambient environment candidate matching the predicted ambient environment candidate.

By this configuration, for example, the similarity level of an ambient environment candidate matching a predicted ambient environment candidate becomes low by performing a weighting process in which the similarity level is multiplied by a numerical value between 0 and 1, and the ambient environment candidate is easily selected as an estimation ambient environment. Therefore, it is possible to improve the accuracy of estimating ambient environments.

In the environment adaptive type hearing aid of the present invention, the hearing ability compensation system determining section outputs ON/OFF information for each hearing ability compensating function provided in the hearing aid as the hearing ability compensation system to the hearing ability compensating section.

By this configuration, for example, it is possible to realize a desired hearing aid process by turning on a dish noise suppressing function during eating and turning on an electric train noise suppressing function during commuting.

In the environment adaptive type hearing aid of the present invention, the hearing ability compensation system determining section outputs a weight coefficient and an increase/decrease ratio of each frequency band as the hearing ability compensation system to the hearing ability compensating section.

By this configuration, for example, it is possible to realize a desired hearing aid process by considering hearing ability characteristics of a hearing aid user, increasing a gain amplification ratio in a frequency band in which hearing is difficult, and decreasing a gain amplification ratio in a frequency band in which hearing is easy.

In the environment adaptive type hearing aid of the present invention, the hearing ability compensating section includes: a frequency dividing section that converts the input signal from a time domain signal into a frequency domain signal and outputs a frequency signal of each frequency band; a power calculating section that calculates power of the frequency signal; a gain adjusting section for adjusting a setting gain of each frequency band in correspondence with the hearing ability compensation system after acquiring a setting gain which is predetermined so as to comply with hearing ability characteristics of a hearing aid user for each frequency band from a gain table;

a gain multiplying section that outputs an adjusted signal by multiplying power of each frequency band by the adjusted gain; and a frequency synthesizing section that converts a frequency domain signal into a time domain signal on the basis of the adjusted signal of each frequency band.

By this configuration, it is possible to perform a desired hearing aid process at each frequency.

Advantageous Effects

According to an environment adaptive type hearing aid of the present invention, it is possible to improve the accuracy of estimating ambient environments since an ambient environment varying with a time band is registered in advance and used for ambient environment estimation when a hearing aid process is performed.

According to an environment adaptive type hearing aid of the present invention, it is possible to improve the accuracy of estimating ambient environments since an ambient environment varying with a place is registered in advance and used for ambient environment estimation when a hearing aid process is performed.

According to an environment adaptive type hearing aid of the present invention, it is possible to improve the accuracy of estimating ambient environments since an ambient environment varying with speed is registered in advance and used for ambient environment estimation when a hearing aid process is performed.

| Explanation of Reference | |
|---|---|
| 100: | SCHEDULED ENVIRONMENT SPECIFYING SECTION |
| 110: | INPUT SECTION |
| 120a, 120b: | INPUT SIGNAL |
| 130: | HEARING ABILITY COMPENSATING SECTION |
| 140: | OUTPUT SIGNAL |
| 150: | OUTPUT SECTION |
| 160: | TIME ACQUIRING SECTION |
| 170: | PRESENT TIME |

-continued

| Explanation of Reference | |
|---|---|
| 180: | SCHEDULED ENVIRONMENT REFERRING SECTION |
| 190: | SCHEDULED ENVIRONMENT |
| 200: | ENVIRONMENT ESTIMATING SECTION |
| 210: | ESTIMATED AMBIENT ENVIRONMENT |
| 220: | HEARING ABILITY COMPENSATION SYSTEM DETERMINING SECTION |
| 230: | HEARING ABILITY COMPENSATION SYSTEM |
| 270: | SCHEDULED ENVIRONMENT TABLE |
| 280: | SCHEDULED ENVIRONMENT SETTING SECTION |
| 290: | SCHEDULED ENVIRONMENT SEARCHING SECTION |
| 310: | FEATURE QUANTITY CALCULATING SECTION |
| 320: | FEATURE QUANTITY |
| 330: | SIMILARITY LEVEL CALCULATING SECTION |
| 340: | AMBIENT ENVIRONMENT TABLE |
| 350: | SIMILARITY LEVEL |
| 360: | ESTIMATION ENVIRONMENT OUTPUT SECTION |
| 410: | FREQUENCY DIVIDING SECTION |
| 420a, 420b: | FREQUENCY SIGNAL |
| 430: | POWER CALCULATING SECTION |
| 440: | POWER |
| 450: | GAIN ADJUSTING SECTION |
| 460: | GAIN TABLE |
| 470: | SETTING GAIN |
| 480: | ADJUSTED GAIN |
| 490: | GAIN MULTIPLYING SECTION |
| 500: | ADJUSTED SIGNAL |
| 510: | FREQUENCY SYNTHESIZING SECTION |
| 520: | PRESENT LOCATION ACQUIRING SECTION |
| 530: | PRESENT LOCATION |
| 540: | REGIONAL ENVIRONMENT REFERRING SECTION |
| 550: | REGIONAL ENVIRONMENT |
| 610: | REGIONAL ENVIRONMENT TABLE |
| 620: | REGIONAL ENVIRONMENT SETTING SECTION |
| 630: | REGIONAL ENVIRONMENT SEARCHING SECTION |
| 710: | SPEED ENVIRONMENT REFERRING SECTION |
| 720: | SPEED ENVIRONMENT |
| 810: | SPEED ENVIRONMENT TABLE |
| 820: | SPEED ENVIRONMENT SETTING SECTION |
| 830: | SPEED ENVIRONMENT SEARCHING SECTION |
| 840: | MOVEMENT SPEED CALCULATING SECTION |
| 850: | PREVIOUS LOCATION |
| 860: | MOVEMENT SPEED |
| 910: | TOTAL ENVIRONMENT SELECTING SECTION |
| 920: | TOTAL ENVIRONMENT |

BEST MODE FOR CARRYING OUT THE INVENTION

Hereinafter, an embodiment of an environment adaptive type hearing aid of the present invention will be described in detail with reference to the drawings.

First Embodiment

Figure 1:
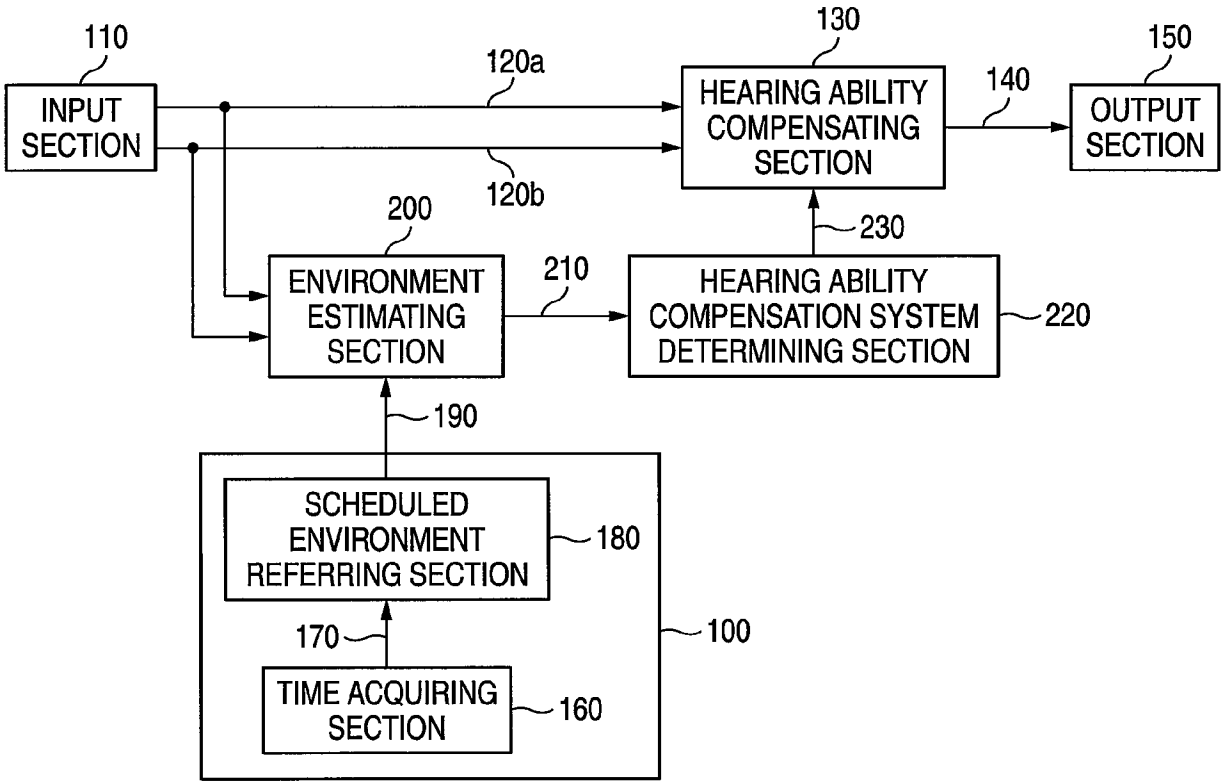
FIG. 1 is a block diagram of an environment adaptive type hearing aid according to a first embodiment of the present invention.

FIG. 1 is a block diagram of an environment adaptive type hearing aid according to a first embodiment of the present invention. As illustrated in FIG. 1, the environment adaptive type hearing aid of this embodiment includes an input section 110, a hearing ability compensating section 130, an output section 150, a scheduled environment specifying section 100, an environment estimating section 200, and a hearing ability compensation system determining section 220.

The input section 110 collects a sound of an audible area by a microphone, appropriately amplifies the collected sound, performs an A/D conversion process for the amplified sound, and acquires an input signal 120. It is possible to constitute one microphone here, but a configuration in which two microphones are mounted in the front and rear will be described in the following. In the case of the two microphones, the input section 110 converts analog signals output from the two microphones into a digital signal by the A/D conversion process, and outputs the signal collected by the front microphone as an input signal 120*a* and the signal collected by the rear microphone as an input signal 120*b*.

The hearing ability compensating section 130 converts the input signal 120*a* of the input signal 120*a* and the input signal 120*b* acquired by the input section 110 into an output signal 140 as required to comply with preset hearing ability characteristics of the hearing aid user.

The output section 150 converts the output signal 140 into which the input signal 120 has been converted by the hearing aid compensating section 130 using a D/A conversion process, and outputs the converted signal to a receiver (an earphone or speaker).

The scheduled environment specifying section 100 includes a time acquiring section 160 and a scheduled environment referring section 180, and outputs environment information corresponding to a schedule at a present time.

The time acquiring section 160 acquires a present time 170 by a clock function built in the hearing aid. The time acquiring section 160 may simultaneously acquire a date as well as the time. In this case, the present time 170 has information regarding the date and the time. The present time 170 may be stored as a numerical value or a character string capable of being converted from the date and the time by one to one conversion. The timing when the time acquiring section 160 acquires the present time 170 is determined by setting a time band of the scheduled environment table 270. As described later, when a minimum time band of the scheduled environment table 270 is 10 minutes, the time is acquired every 10 minutes.

Figure 2:
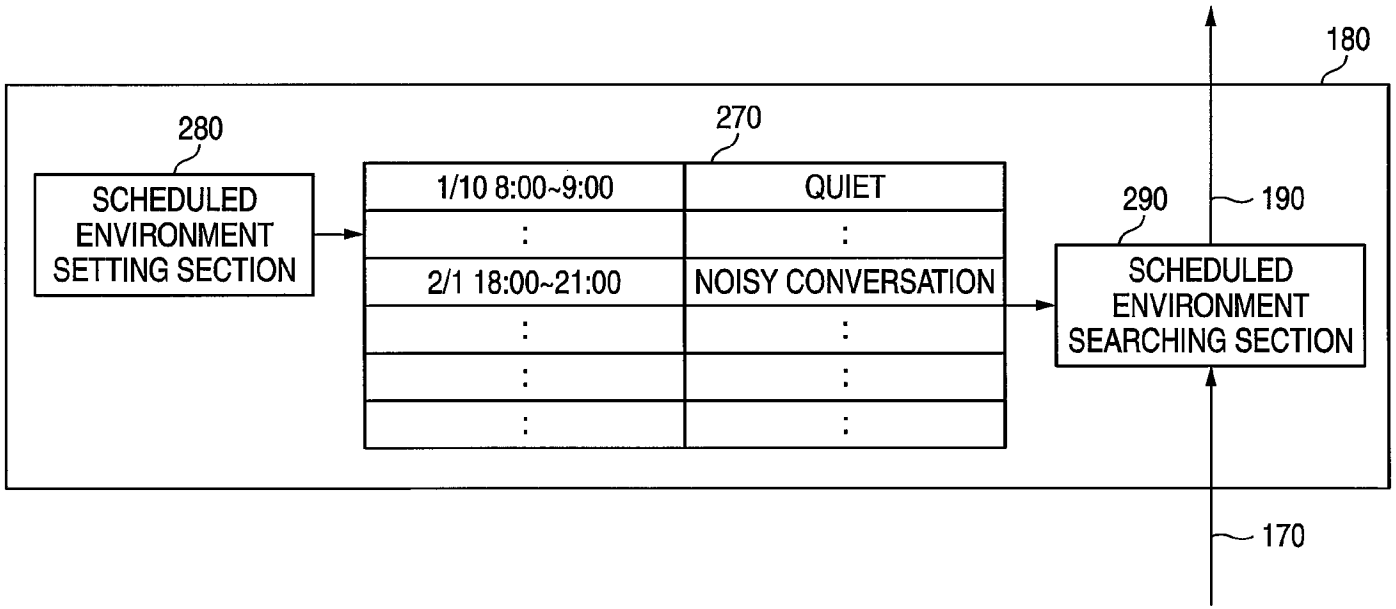
FIG. 2 is a detailed block diagram of a scheduled environment referring section according to the first embodiment of the present invention.

The scheduled environment referring section 180 selects a scheduled environment 190 on the basis of the present time 170 acquired by the time acquiring section 160, and outputs the selected scheduled environment 190 to the hearing aid compensation system determining section 220. The scheduled environment referring section 180 has a function as a scheduled environment referring section having a predicted ambient environment table to store predicted ambient environment candidates corresponding to ambient environments other than an ambient sound set in advance for the hearing aid. A scheduled environment is an environment where the hearing aid user is located by a scheduled behavior pattern. FIG. 2 is a detailed block diagram of the scheduled environment referring section 180 according to the first embodiment of the present invention. As illustrated in FIG. 2, the scheduled environment referring section 180 includes a scheduled environment table 270, a scheduled environment setting section 280, and a scheduled environment searching section 290. Hereinafter, the details of the scheduled environment referring section 180 will be described using FIG. 2.

The scheduled environment table 270 stores a plurality of information sets in which time bands are paired with scheduled environment candidates. The time bands and the scheduled environment candidates of the scheduled environment table 270 are preset via the scheduled environment setting section 280 as shown in the scheduled environment table 270 of FIG. 2. The scheduled environment setting section 280 has a wireless communication module to communicate with an external device. For example, there is a wireless communication protocol such as Bluetooth (registered trademark) or the like.

The scheduled environment setting section 280 sequentially stores the sets of time bands and scheduled environment candidates transmitted from the external device in the scheduled environment table 270. The scheduled environment table 270 is stored in order of time bands for an efficient search. Alternatively, the scheduled environment setting section 280 is connected to a fitting device by a connection port, so that the sets of time bands and scheduled environment candidates may be received from the fitting device and may be stored in the scheduled environment table 270.

Here, the scheduled environment candidates will be described. Table 1 shows an example of the scheduled environment candidates. Parameters set in each mode are written in Table 1. Here, each mode, that is, "Quiet", "Conversation", "Noisy Conversation", "Office Work", "Eating", or "Commuting", is a scheduled environment candidate. Among these, "Quiet", "Conversation", "Noisy Conversation", and "Office Work" are general environments, and "Eating" and "Commuting" are special environments. Parameters "Noise Suppression", "Sound Detection Level", "Dish Noise Suppression", and "Electric Train Noise Suppression" are hearing ability compensation systems to be used by the hearing ability compensation system determining section 220. Each parameter and setting thereof will be described in detail with reference to the hearing aid compensation system determining section 220.

TABLE 1

| | Noise Suppression | Sound Detection Level | Dish Noise Suppression | Electric Train Noise Suppression |
|---|---|---|---|---|
| Quiet | Weak | Weak | | |
| Conversation | Weak | Strong | | |
| Noisy Conversation | Strong | Strong | | |
| Office Work | Strong | Weak | | |
| Eating | Weak or Strong | Weak or Strong | ON | |
| Commuting | Weak or Strong | Weak or Strong | | ON |

The time bands of the scheduled environment table 270 are expressed in a unit of a preset minimum time band. For example, the unit of the minimum time band is 10 or 30 minutes or the like. As for a scheduled environment candidate of each time band, a candidate serving as a standard is determined and only time bands in which candidates other than standards are scheduled are stored in the scheduled environment table 270. For example, "Noisy Conversation" is set as the standard from 8:00 am to 10:00 pm, and "Quiet" is set as the standard from 10:00 pm to 8:00 am.

At this time, when others except the standards are not stored in the scheduled environment table 270, the scheduled environment candidate of the above-described standard is directly output as the scheduled environment 190. For example, when the time band from 8:30 am to 9:00 am and "Commuting" as the pair are set in the scheduled environment table 270, "Commuting" as the scheduled environment 190 is output between 8:30 am and 9:00 am and the scheduled environment candidate of the standard is output in other time bands.

Since it is possible to store only a time band in which a process of changing hearing aid setting is necessary, power consumption can be reduced by reducing a storage area. Of course, it is possible to divide 24 hours into a plurality of time bands in the scheduled environment table 270 and store a scheduled environment candidate for each time band.

When the present time 170 from the time acquiring section 160 is updated, the scheduled environment searching section 290 searches the scheduled environment table 270 from the beginning, refers to a scheduled environment candidate of a time band to which the present time 170 belongs, and outputs the scheduled environment candidate as the scheduled environment 190 to the environment estimating section 200. A first change time of a scheduled environment candidate and the scheduled environment candidate are stored by pre-searching for the time band of the scheduled environment table 270, so that the scheduled environment 190 may be updated when the time has been reached. In this case, the next change time of the scheduled environment candidate and the scheduled environment candidate are stored by re-searching the scheduled environment table 270 whenever the scheduled environment 190 is updated.

Figure 3:
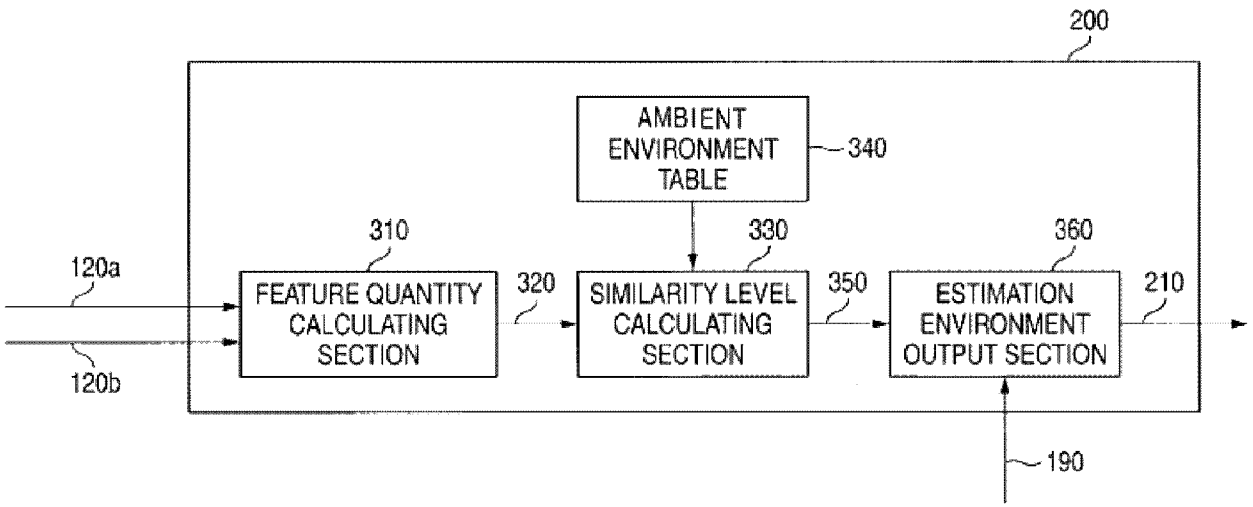
FIG. 3 is a detailed block diagram of an environment estimating section according to the first embodiment of the present invention.

The environment estimating section 200 extracts a feature quantity from the input signal 120, estimates an ambient environment on the basis of the input signal 120, and outputs the estimated ambient environment as an estimated surround environment 210 to the hearing ability compensation system determining section 220. FIG. 3 is a detailed block diagram of the environment estimating section 200 according to the first embodiment of the present invention. As illustrated in FIG. 3, the environment estimating section 200 includes a feature quantity calculating section 310, a similarity level calculating section 330, an ambient environment table 340, and an estimation environment output section 360. Hereinafter, the details of the environment estimating section 200 will be described using FIG. 3.

The feature quantity calculating section 310 separates a sound signal and a noise signal from the input signal 120*a* and the input signal 120*b* using a beamformer or the like. For example, a Griffiths-Jim beamformer is used. A feature quantity 320 necessary for estimating the ambient environment from the sound signal and the noise signal is calculated. The feature quantity 320 includes a sound-signal average sound pressure level, a noise-signal average sound pressure level, a sound signal duration time, or a noise signal duration time. The sound-signal average sound pressure level is an average of sound pressure levels of sound signals obtained from the input signals 120*a* and 120*b* in a given time in the past. Likewise, the noise-signal average sound pressure level is an average of sound pressure levels of noise signals obtained from the input signals 120*a* and 120*b* in a given time in the past. The sound signal duration time indicates how much time has elapsed in the past in a state in which a sound pressure level of a sound signal obtained from the input signals 120*a* and 120*b* is equal to or greater than a specific threshold level. Likewise, the noise signal duration time indicates how much time has elapsed in the past in a state in which a sound pressure level of a noise signal obtained from the input signals 120*a* and 120*b* is equal to or greater than a specific threshold level.

The similarity level calculating section 330 calculates a similarity level 350 to a defined feature quantity for each ambient environment candidate stored in the ambient environment table 340 on the basis of the feature quantity 320 calculated by the feature quantity calculating section 310. The ambient environment table 340 stores a set of an ID indicating an environment and values of several standard feature quantities in the environment for each ambient environment candidate, and stores a plurality of sets whose number corresponds to the number of ambient environment candidates.

Here, the ambient environment candidates will be described. Table 2 shows an example of the ambient environment candidates. Parameters set in each mode are written in Table 2. As in the scheduled environment candidate, each mode, that is, "Quiet", "Conversation", "Noisy Conversation", or "Office Work", is an ambient environment candidate. Parameters "Noise Suppression" and "Sound Detection Level" are hearing ability compensation systems to be used by the hearing ability compensation system determining section 220. The ambient environment candidates are different from the scheduled environment candidates in that only the modes corresponding to general environments exist, and special environments and parameters corresponding thereto do not exist. This is because a standard feature quantity in the special environment of "Eating" or "Commuting" is noticeably similar to a standard feature quantity of "Noisy Conversation" or "Office Work", and it is difficult to estimate the special environment only from the input signal 120.

TABLE 2

| | Noise Suppression | Sound Detection Level |
|---|---|---|
| Quiet | Weak | Weak |
| Conversation | Weak | Strong |
| Noisy Conversation | Strong | Strong |
| Office Work | Strong | Weak |

For example, as for a standard value of a feature quantity in the environment of "Quiet", the sound-signal average sound pressure level and the noise-signal average sound pressure level are set to be low and the sound signal duration time and the noise signal duration time are set to be short. In the environment of "Conversation", the sound-signal average sound pressure level is set to be high and the noise-signal average sound pressure level is set to be low. Likewise, in the environment of "Noisy Conversation", the sound-signal average sound pressure level is set to be low and the noise-signal average sound pressure level is set to be high. In the environment of "Office Work", the sound-signal average sound pressure level and the noise-signal average sound pressure level are set to be high. An ID and a standard feature quantity value of an environment candidate of the ambient environment table 340 like the scheduled environment table 270 are preset by an external fitting device or the like via an environment candidate setting section (not shown).

The similarity level calculating section 330 produces a difference between each of the 4 feature quantities 320, that is, the sound-signal average sound pressure level, the noise-signal average sound pressure level, the sound signal duration time, and the noise signal duration time, calculated by the feature quantity calculating section 310, and a standard value of each of the 4 feature quantities set for each environment candidate stored in the ambient environment table 340, produces the square of each difference, produces a sum of square values, and sets the square sum to a similarity level 350. The similarity level 350 is calculated as one value produced from the 4 feature quantities. When the similarity level 350 calculated for each environment candidate has a small value, the similarity is high. When the similarity level 350 calculated for each environment candidate has a large value, the similarity is low. Here, the environment candidates of the ambient environment table 340 and the similarity level of each environment candidate are arranged and the similarity level 350 is transmitted to the estimation environment output section 360.

The estimation environment output section 360 corrects the similarity level 350 and outputs an environment candidate corresponding to a minimal similarity level of corrected similarity levels as an estimation ambient environment 210. That is, the estimation environment output section 360 refers to the scheduled environment 190 referred to by the scheduled environment referring section 180, and adjusts the similarity level 350 by decreasing a value with a weight, which is equal to or greater than 0 and equal to or less than 1, with respect to the similarity level corresponding to the environment candidate matching the scheduled environment 190.

When the similarity level of the environment candidate matching the scheduled environment 190 is decreased as described above, the environment candidate matching the scheduled environment 190 is easily selected as the estimation ambient environment 210. When the feature quantity 320 exhibits a feature noticeably different from that corresponding to the scheduled environment 190, the similarity level corresponding to an environment candidate different from the scheduled environment 190 becomes small among the similarity levels 350 output from the similarity level calculating section 330, and the similarity level corresponding to the environment candidate matching the scheduled environment 190 becomes relatively large. The scheduled environment 190 noticeably different from the environment candidate estimated from sound information input to the hearing aid is not selected as the estimation ambient environment 210 since the similarity level does not become minimal even when the similarity level corresponding to the scheduled environment 190 is decreased by correcting the similarity level by the estimation environment output section 360.

In this case, a weight value assigned to the similarity level corresponding to the environment candidate matching the scheduled environment 190 by the estimation environment output section 360 is defined so that the similarity level corresponding to the scheduled environment 190 does not become minimal. When the user is located in an environment significantly different from an ambient environment preset at the time, information regarding the ambient environment has a priority and it is possible to cope with unusual unscheduled behavior.

For example, the estimation environment output section 360 selects "Quiet" even though "Noisy Conversation" is input as the scheduled environment 190 when the similarity level of "Quiet" becomes minimal among similarity levels 350 output from the similarity level calculating section 330. This is because the sound-signal average sound pressure level and the noise-signal average sound pressure level of "Quiet" are low, but the sound-signal average sound pressure level and the noise-signal average sound pressure level of "Noisy Conversation" are high, and because a similarity difference between the two is large and the two become noticeably different environments. Likewise, "Conversation" and "Office Work" are noticeably different environments and the similarity level 350 has a priority. In contrast, a similarity difference between "Quiet" and "Conversation" or "Office Work", or between "Noisy Conversation" and "Conversation" or "Office Work" is small, and the changeover is facilitated by the scheduled environment 190 as the similar environment. It is desirable to set a weight value in which both the above-described conditions are satisfied. The above description is the case where the general environment has been selected as the scheduled environment 190.

Next, the operation of the estimation environment output section 360 in the case where the special environment of "Eating" or "Commuting" has been selected as the scheduled environment 190 will be described. The special environment is an environment in which a parameter such as "Eating" or "Electric Train" has been added to one of the 4 general environments. As in the case where the scheduled environment 190 is the general environment, the estimation environment output section 360 corrects the similarity level 350 and selects one of the 4 general environments. In addition, the presence or absence of the special environment parameter is added and output as the estimation ambient environment 210.

That is, as for the estimation ambient environment 210, information regarding one of the 4 general environments and the presence or absence of a parameter corresponding to the special environment are output to the hearing aid compensation system determining section 220. For example, if the scheduled environment candidates are Table 1, information regarding one of the 4 general environments, "Dish OFF", and "Electric Train OFF" is provided when the scheduled environment 190 is the general environment. When the scheduled environment 190 is "Eating", information regarding one of the 4 general environments, "Dish ON", and "Electric Train OFF" is provided.

When a special environment has been selected as the scheduled environment 190, no general environment may be set. When no general environment is set, the scheduled environment 190 does not match the environment candidate.

Alternatively, the estimation environment output section 360 may receive the feature quantity 320 output from the feature quantity calculating section 310 and may change the selection of the estimation ambient environment 210. For example, when "Conversation" or "Noisy Conversation" having the strong sound detection level is selected in the case where the sound-signal average sound pressure level is excessively high, the sound may be unduly amplified. In this case, an adjustment process may be automatically performed by the hearing aid compensating section 130, but a correction process may be performed by the environment estimating section 200. Specifically, the sound-signal average sound pressure level is compared with a predetermined threshold. When the level is greater than the threshold, "Quiet" or "Office Work" may be selected. That is, when the sound-signal average sound pressure level of the input signal is equal to or greater than a predetermined threshold, the estimation environment output section 360 estimates the environment candidate having a gain which is equal to or less than a predetermined value in the hearing ability compensating section 130 as an estimation ambient environment.

Likewise, a threshold is set in the case where the sound-signal average sound pressure level is excessively low or in the case where the noise-signal average sound pressure level is excessively high or excessively low, and the estimation ambient environment 210 is selected regardless of the similarity level 350 at more than the threshold.

Alternatively, the estimation environment output section 360 may receive the feature quantity 320 output by the feature quantity calculating section 310 and may cancel a process of adjusting the similarity level 350 based on the scheduled environment 190 by its value. For example, when the ambient environment is not the conversation, but is "Office Work" surrounded by noise, it is assumed that "Noisy Conversation" is set as the scheduled environment 190. At this time, when a personal computer generating a slightly large operational sound is located in the front of the user, the similarity level 350 may be changed to select "Noisy Conversation" by an adjustment process by the scheduled environment 190. The sound generated from the personal computer is amplified and the user feels uncomfortable. When the ambient environment is estimated, the estimation environment output section 360 may switch whether or not to consider the scheduled environment candidate.

In this case, an adjustment process may be automatically performed by the hearing aid compensating section 130, but a correction process may be performed by the environment estimating section 200. Specifically, when the sound-signal average sound pressure level is constantly continued in more than a predetermined time, a process of adjusting the similarity level 350 by the scheduled environment 190 is cancelled. When an object generating a constant sound such as the operation sound of the personal computer or the like is located in the front of the user, a possibility that "Noisy Conversation" may be selected is low and "Office Work" is easily selected when the user uses the personal computer in the office.

Next, the hearing ability compensation system determining section 220 determines a hearing ability compensation system 230 corresponding to the estimation ambient environment 210. As for the hearing aid compensation system 230, a strong/weak or ON/OFF signal of each hearing aid compensating function provided in the hearing aid is output to the hearing aid compensating section 130. When the scheduled environment candidates are the same as shown in Table 1, the hearing ability compensating functions provided in the hearing aid are a strong/weak operation of a noise suppressing function, a strong/weak operation of a sound detection level function, an ON/OFF operation of a dish noise suppressing function, and an ON/OFF operation of an electric train noise suppressing function. In the hearing ability compensation system determining section 220, the hearing aid compensating functions as described in Table 1 are preset. For example, in "Quiet", the noise suppressing function is set to be weak and the sound detection level function is set to be weak. The ON/OFF operation of the dish noise suppressing function and the electric train noise suppressing function is set from the estimation ambient environment 210.

Figure 4:
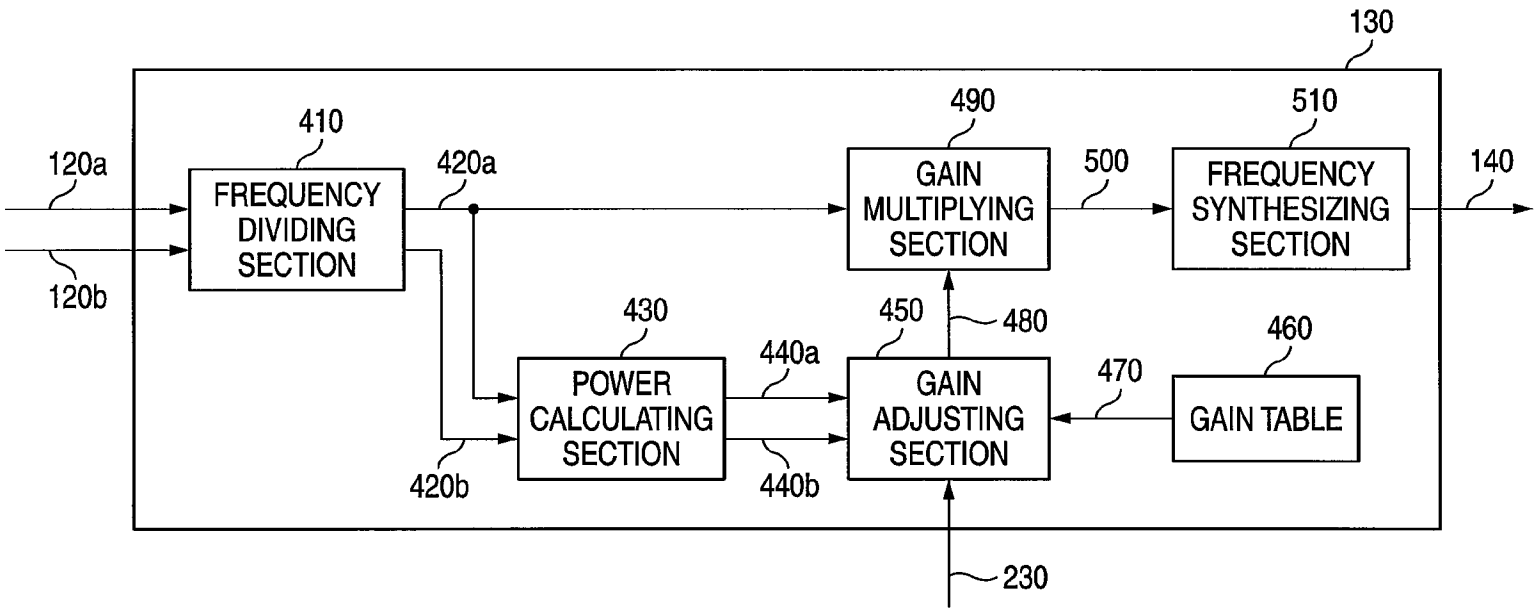
FIG. 4 is a detailed block diagram of a hearing ability compensating section according to the first embodiment of the present invention.

As described above, the hearing ability compensating section 130 converts the input signal 120*a* of the input signals 120*a* and 120*b* acquired by the input section 110 into an output signal 140 as required to comply with preset hearing ability characteristics of the hearing aid user, but refers to the hearing ability compensation system 230 determined by the hearing ability compensation system determining section 220 at the time. FIG. 4 is a detailed block diagram of the hearing ability compensating section 130 according to the first embodiment of the present invention. As illustrated in FIG. 4, the hearing ability compensating section 130 includes a frequency dividing section 410, a power calculating section 430, a gain adjusting section 450, a gain table 460, a gain multiplying section 490, and a frequency synthesizing section 510. Hereinafter, the details of the hearing ability compensating section 130 will be described using FIG. 4.

The frequency dividing section 410 converts the input signal 120*a* and the input signal 120*b* acquired by the input section 110 from time domain signals into frequency domain signals, and outputs frequency signals 420*a* and 420*b* of each frequency band to the power calculating section 430 and the gain multiplying section 490. A time-frequency conversion method like the Fourier transform or a sub-band division method of dividing a frequency band by a filter bank is used as a dividing method of the frequency dividing section 410.

The power calculating section 430 calculates powers of the frequency signal 420*a* and the frequency signal 420*b* of each frequency band, and outputs the calculated powers as power 440*a* corresponding to the input signal 120*a* and power 440*b* corresponding to the input signal 120*b* to the gain adjusting section 450.

The gain adjusting section 450 acquires a setting gain 470 of each preset frequency band from the gain table 460 as required to comply with hearing ability characteristics of the hearing aid user, and adjusts the setting gain 470 of each frequency band to output an adjusted gain 480 to the gain multiplying section 490 in correspondence with the hearing ability compensation system 230 determined by the hearing ability compensation system determining section 220.

The gain table 460 stores the setting gain 470 as required to comply with the hearing ability characteristics of the hearing aid user, that is, a dynamic range (a hearing range) of each frequency band. As in the scheduled environment table 270, the setting gain 470 is preset via a gain setting section (not shown) from an external fitting device or the like.

For example, when the noise suppression is weak, the sound detection level is weak, and "Dish" is ON, the gain adjusting section 450 decreases a reduction ratio when reducing noise using a method of detecting a sound interval and a noise interval from the power 440*a* and the power 440*b* calculated by the power calculating section 430 and subtracting a spectrum of noise estimated in the noise interval from a spectrum of a sound signal (spectrum subtraction), and outputs the adjusted gain 480 by adjusting the setting gain 470 so that a sound occurring when using dining ware is reduced.

Here, a gain for reducing the sound occurring when using dining ware and a gain for reducing a running sound of an electric train are pre-registered in the gain adjusting section 450, and the gain is superimposed on a gain suitable for the hearing aid user.

The gain multiplying section 490 multiplies the frequency signal 420*a* output from the frequency dividing section 410 by the adjusted gain 480, and outputs an adjusted signal 500.

The frequency synthesizing section 510 converts a frequency domain signal into a time domain signal on the basis of the adjusted signal 500 of each frequency band, and outputs an output signal 140 to the receiver. The frequency synthesizing section 510 synthesizes signals by a method corresponding to the dividing method of the frequency dividing section 410. That is, the inverse Fourier transform is used when the dividing method is the Fourier transform, and the sub-band synthesis is used when the dividing method is the sub-band division.

In the first embodiment as described above, the scheduled environment referring section which refers to a preset scheduled environment on the basis of a present time is provided and used to estimate ambient environments, thereby reducing the unnecessary changeover of a hearing aid process due to erroneous estimation of ambient environments, improving the accuracy of estimating ambient environments, and switching a hearing aid process without giving an uncomfortable feeling to the hearing aid user.

That is, the accuracy of estimating ambient environments is improved since the accuracy of selecting proper ambient environments is improved by adding information regarding scheduled environments when environment estimation is performed using a similarity level.

The environment estimating section 200, the hearing ability compensation system determining section 220, or the hearing ability compensating section 130 has been illustrated in the first embodiment, but it is not limited thereto. It is possible to reduce erroneous ambient environment estimation by combining a scheduled environment to be referred to from the present time disclosed in the present invention with a method using the environment estimating section or the hearing ability compensating section well known to those skilled in the art.

The time acquiring section 160 having a configuration of a built-in clock function has been described, but the time acquiring section 160 may be constituted to acquire the present time from a device having a clock function outside the hearing aid by a certain communication section. A portable phone, a PC, a PDA (Personal Digital Assistant), or the like may be included as an example of the device having the clock function. The above-described communication section may be shared with the scheduled environment setting section 280 located in the scheduled environment referring section 180.

Alternatively, a configuration may be made so that a module which receives a standard radio wave is provided to acquire the present time from the standard radio wave.

The scheduled environment setting section 280 may communicate with a portable phone, a PDA, or a personal computer to update a schedule in synchronization with a scheduler thereof. At this time, the scheduled environment setting section 280 assigns the transmitted schedule to a scheduled environment to be used by the scheduled environment table 270 and stores the assigned schedule in the scheduled environment table 270. Thus, the hearing aid user may easily update the scheduled environment by only managing the schedule.

When the determined estimation ambient environment 210 matches the scheduled environment 190, the environment estimating section 200 may extend a time interval in which the estimation ambient environment 210 is estimated. In contrast, when the estimation ambient environment 210 mismatches the scheduled environment 190, the estimation time interval may be narrowed.

A method of designating the hearing ability compensation system 230 determined by the hearing ability compensation system determining section 220 may make an expression by a weight coefficient or an increase/decrease ratio of a gain of each frequency band so that an environment where a sound of a specific frequency such as a sound of an air conditioner or the like is generated may be expressed. At this time, it is desirable to add a special environment of the scheduled environment candidate of Table 1.

The feature quantity calculating section 310 which calculates the sound-signal average sound pressure level, the noise-signal average sound pressure level, the sound signal duration time, or the noise signal duration time as the feature quantity 320 has been described, but the feature quantity calculating section 310 may calculate a sound pitch, a sound distribution, or the like as the feature quantity so as to estimate more specifically an ambient environment.

Although not shown in Table 1, "Bicycle" may be added as the special environment. For example, it is valid in the case where bicycle riding is included in a daily routine such as commuting to work or commuting to school in a predetermined time band. During bicycle riding a wind sound increases. It is possible to reduce the wind sound to an acceptable level by providing a wind noise suppressing function to suppress the wind sound and turning on the wind noise suppressing function.

When the wind noise is suppressed, a predetermined low-frequency sound is suppressed. When dish noise in another special environment is suppressed, a predetermined high-frequency sound is suppressed. When electric train noise is suppressed, a predetermined low-frequency sound is suppressed.

Second Embodiment

Figure 5:
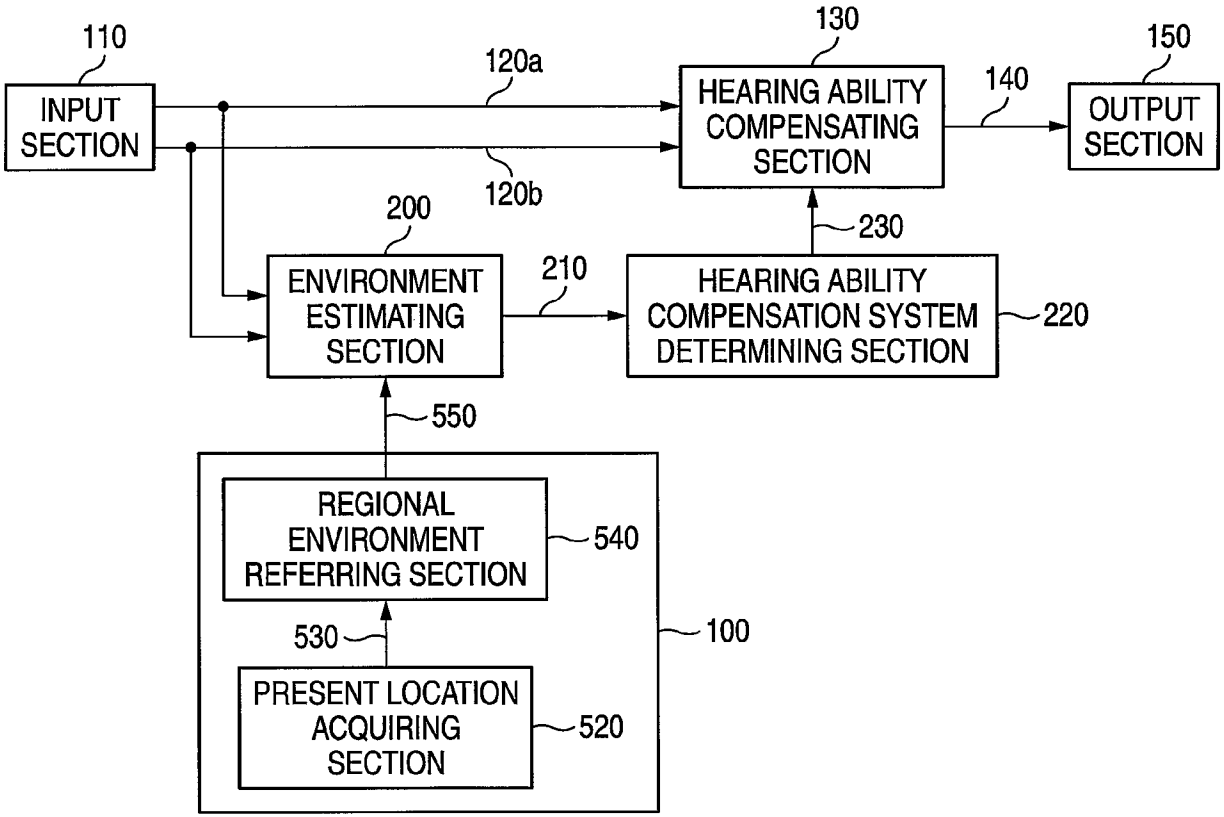
FIG. 5 is a block diagram of an environment adaptive type hearing aid according to a second embodiment of the present invention.

FIG. 5 is a block diagram of an environment adaptive type hearing aid according to a second embodiment of the present invention. As illustrated in FIG. 5, the environment adaptive type hearing aid of this embodiment includes an input section 110, a hearing ability compensating section 130, an output section 150, a scheduled environment specifying section 100, an environment estimating section 200, and a hearing ability compensation system determining section 220.

A difference from the first embodiment is that the scheduled environment specifying section 100 includes a present location acquiring section 520 and a regional environment referring section 540 and outputs a regional environment 550 to the environment estimating section 200, and an estimation environment output section 360 within the environment estimating section 200 adjusts a similarity level 350 using the regional environment 550. Since the content of the regional environment 550 is the same as that of the scheduled environment 190 shown in the first embodiment, the operations of the estimation environment output section 360 and the hearing ability compensation system determining section 220 are the same.

Accordingly, the present location acquiring section 520 and the regional environment referring section 540 having different configurations will be described in detail in this embodiment. Since other elements are the same as those of the first embodiment, description thereof is omitted or simplified.

The present location acquiring section 520 acquires a present location 530 by a present location acquiring function built in the hearing aid. For example, the present location acquiring section 520 may use a GPS (Global Positioning System). The GPS acquires radio waves transmitted from a plurality of artificial satellites orbiting around Earth. The GPS may measure location information of a reception point by detecting the radio wave propagation delay at the reception point. In the GPS, time acquiring means is necessary for detecting a radio wave propagation delay time. In general, when the number of captured artificial satellites is 3 or 4, the location information of the reception point is correct. The present location 530 is the location information of the reception point, and is described by indicating one point on a map by two-dimensional coordinates using the latitude and the longitude in the following However, the data format of the location information may use a dedicated three-dimensional coordinate system as well as the latitude and the longitude to indicate one point on the map, so that it is not limited to the latitude and the longitude. The data format of a numerical value or a character string capable of being converted from the present location by one to one conversion may be used.

For example, the present location acquisition timing is set at an interval of 10 minutes. The present location acquiring section 520 may include a cycle counter making one completion revolution in 10 minutes, which acquires the present location whenever the cycle counter is reset.

The regional environment referring section 540 refers to a regional environment candidate of a preset region on the basis of the present location 530 acquired by the present location acquiring section 520. The regional environment referring section 540 has a function as a predicted environment referring section having a predicted ambient environment table to store predicted ambient environment candidates corresponding to ambient environments other than an ambient sound set in advance for the hearing aid. Here, the region indicates a specific area on the map. For example, the region is a rectangular region indicated by coordinates of two points. The width of a region is not limited, but the region may be an area of a width indicating one building or an area of a width indicating an autonomous community. The regional environment candidate is the most likely estimated environment where the hearing aid user is located in its region. For example, an art gallery is a quiet environment and an environment on a railway track (when on an electric train) is a noisy environment.

Figure 6:
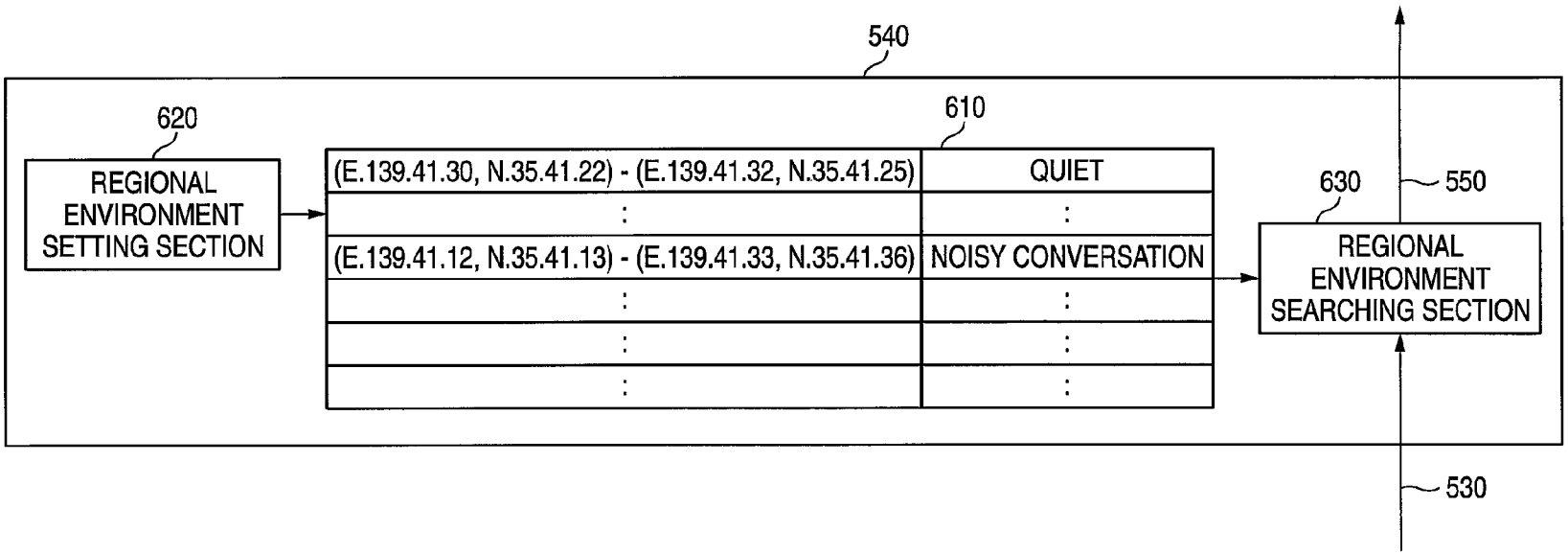
FIG. 6 is a detailed block diagram of a regional environment referring section according to the second embodiment of the present invention.

FIG. 6 is a detailed block diagram of the regional environment referring section 540 according to the second embodiment of the present invention. As illustrated in FIG. 6, the regional environment referring section 540 includes a regional environment table 610, a regional environment setting section 620, and a regional environment searching section 630. Hereinafter, the details of the regional environment referring section 540 will be described using FIG. 6.

The regional environment table 610 stores a plurality of information sets in which regions are paired with regional environment information. The regions and the regional environment information of the regional environment table 610 are preset via the regional environment setting section 620 as shown in the regional environment table of FIG. 6. The regional environment setting section 620 has a wireless communication module to communicate with an external device. For example, there is a wireless communication protocol such as Bluetooth (registered trademark) or the like.

The regional environment setting section 620 sequentially stores the sets of regions and regional environment candidates transmitted from the external device in the regional environment table 610. Alternatively, the regional environment setting section 620 is connected to a fitting device by a connection port, so that the sets of regions and regional environment candidates can be received from the fitting device and can be stored in the regional environment table 610.

The region is indicated by a rectangular area where the coordinates of two points form a diagonal line. For example, the region "(E.139.41.30, N.35.41.22)-(E.139.41.32, N.35.41.25)" on the top in the regional environment table 610 of FIG. 6 indicates an area inside a rectangle having four points (X1, Y1), (X1, Y2), (X2, Y1), and (X2, Y2) as vertices when X1=E.139.41.30, Y1=N.35.41.22, X2=E.139.41.32, and Y2=N.35.41.25. Here, E.139.41.30 indicates East Longitude, 139 degrees, 41 minutes, 30 seconds, and N.35.41.22 indicates North Latitude, 35 degrees, 41 minutes, 22 seconds.

A region designating method is not limited to a rectangular area where the coordinates of two points form a diagonal line. The region may be indicated by the center coordinates of a circle and a distance from the center or may be indicated by two-point coordinates indicating a segment and a distance (width) from the segment. The segment may easily indicate a railway track or a road as a region. In the region designating method, a rectangle, a circle, and a segment may be mixed in response to a region shape. When they are mixed, an external fitting device selects an optimal designation method in response to a set region.

Here, regional environment candidates will be described. Table 3 shows an example of the regional environment candidates. Parameters set in each mode are written in Table 3. Here, each mode, that is, "Quiet", "Conversation", "Noisy Conversation", "Office Work", "Eating", or "Commuting", is a regional environment candidate. Among these, "Quiet", "Conversation", "Noisy Conversation", and "Office Work" are general environments, and "Eating" and "Commuting" are special environments. Parameters "Noise Suppression", "Sound Detection Level", "Dish Noise Suppression", and "Electric Train Noise Suppression" are hearing ability compensation systems to be used by the hearing ability compensation system determining section 220. Here, in order to simplify the description, an example in which a plurality of region information elements is associated with 4 modes is shown. For example, there are a bedroom, a hotel, and an art gallery in the case of "Quiet". A user or provider can freely set this association using software or the like. Coordinate information and parameters are actually stored in the regional environment table 610, but the user selects region information when using software and one of the modes is automatically selected and stored in the regional environment table 610.

TABLE 3

| | Noise Suppression | Sound Detection Level | Dish Noise Suppression | Electric Train Noise Suppression |
|---|---|---|---|---|
| Quiet Bedroom Hotel Art Gallery | Weak | Weak | | |
| Conversation Conference Room | Weak | Strong | | |
| Noisy Conversation Cafe | Strong | Strong | | |
| Office Work Office | Strong | Weak | | |
| Eating Restaurant | Weak or Strong | Weak or Strong | ON | |
| Commuting Station Railway Track | Weak or Strong | Weak or Strong | | ON |

As for regional environment candidates of each region, standard candidates are determined and only regions where candidates other than the standard are scheduled are stored in the regional environment table 610. For example, "Quiet" is set as the standard at home and "Noisy Conversation" is set as the standard in others.

At this time, when nothing other than the standard is stored in the regional environment table 610, the regional environment candidate of the above-described standard is directly output as the regional environment 550. When a region and "Commuting" are set in the regional environment table 610, "Commuting" is output when entering the region. It is desirable to store the regions of the regional environment table 610 in order from a narrow area to a wide area in correspondence with a search sequence of the regional environment searching section 630.

Since it is possible to store only regions where the change of hearing aid setting is necessary, power consumption can be reduced by reducing a storage area.

General environments which are roughly divided into 4 patterns by places in Table 3 have been described, but region setting may be performed more finely. For example, the noise suppression levels and the sound detection levels in a bedroom, a hotel, and an art gallery may be set to be slightly different from one another in the same "Quiet" mode. It is possible to perform an optimal hearing ability compensating process in response to a region by finely setting a regional environment. The same is true for an ambient environment candidate as well as a regional environment candidate.

When the present location 530 from the present location acquiring section 520 is updated, the regional environment searching section 630 searches the regional environment table 610 from the beginning refers to a regional environment candidate of a region to which the present location 530 belongs, and outputs the regional environment candidate as the regional environment 550 to the environment estimating section 200. When no regional environment candidate of the region to which the present location 530 belongs is stored, the regional environment candidate of the standard is output.

In the environment estimating section 200, the estimation ambient environment 210 is determined by adjusting the similarity level on the basis of the regional environment 550.

In the second embodiment as described above, the regional environment referring section which refers to a preset regional environment on the basis of a present location is provided and used to estimate ambient environments, thereby reducing the unnecessary changeover of a hearing aid process due to erroneous estimation of ambient environments, improving the accuracy of estimating ambient environments, and switching a hearing aid process without giving an uncomfortable feeling to the hearing aid user.

That is, the accuracy of estimating ambient environments is improved since the accuracy of selecting proper ambient environments is improved by adding information regarding regional environments when environment estimation is performed using a similarity level.

A configuration example in which a set of a latitude/longitude and a regional environment candidate is received from an external fitting device and is stored in the regional environment table 610 has been described in the second embodiment, but it is not limited thereto. Map data may be provided in the present location acquiring section 520, and the present location 530 acquired from the present location acquiring section 520 may be a name specifying a place or building or a type such as a field, a school, or the like. In this configuration, the conversion in an external fitting device is unnecessary when a set of a place or building name or a region type and a regional environment candidate is set in the regional environment table 610. A proper hearing ability compensation system is selected since a standard of a category is selected even when going out of a set place if a standard candidate for each category of a name or type is defined in the regional environment table 610.

Although not shown in Table 3, "Bicycle" may be added as the special environment. For example, it is valid in the case where bicycle riding is included in a daily routine such as commuting or commuting to school in a predetermined region. During bicycle riding a wind sound increases. It is possible to reduce the wind sound to an acceptable level by providing a wind noise suppressing function to suppress the wind sound and turning on the wind noise suppressing function.

Third Embodiment

Figure 7:
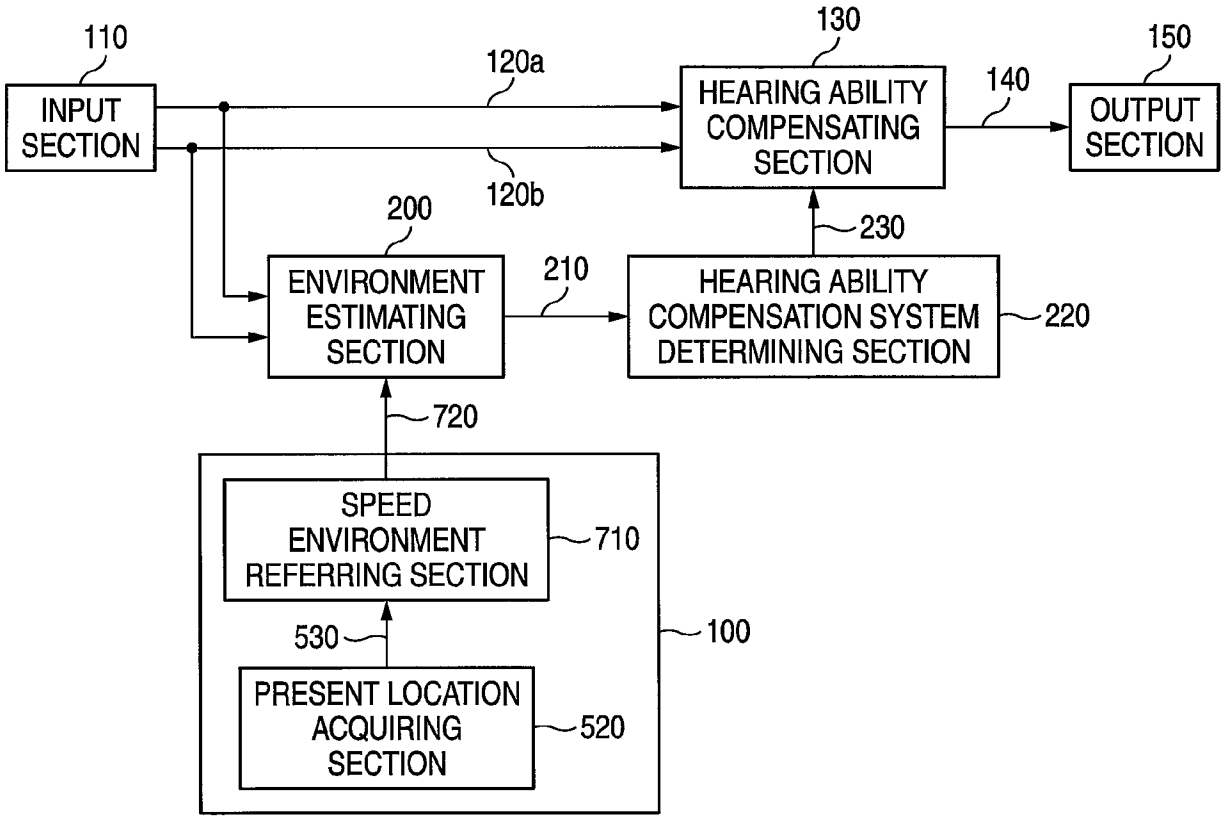
FIG. 7 is a block diagram of an environment adaptive type hearing aid according to a third embodiment of the present invention.

FIG. 7 is a block diagram of an environment adaptive type hearing aid according to a third embodiment of the present invention. As illustrated in FIG. 7, the environment adaptive type hearing aid of this embodiment includes an input section 110, a hearing ability compensating section 130, an output section 150, a scheduled environment specifying section 100, an environment estimating section 200, and a hearing ability compensation system determining section 220.

A difference from the second embodiment is that the scheduled environment specifying section 100 includes a present location acquiring section 520 and a speed environment referring section 710 and outputs a speed environment 720 to the environment estimating section 200, and an estimation environment output section 360 within the environment estimating section 200 adjusts a similarity level 350 using the speed environment 720 (by actually combining the speed environment 720 and the scheduled environment 190 or the regional environment 550). Since the speed environment 720 is used by a combination with the scheduled environment 190 or the regional environment 550 and the content of the combination is the same as that of the scheduled environment 190 shown in the first embodiment and that of the regional environment 550 shown in the second embodiment, the operations of the estimation environment output section 360 and the hearing ability compensation system determining section 220 are the same.

Accordingly, the speed environment referring section 710 having a different configuration will be described in detail in this embodiment. Since other elements are the same as those of the first or second embodiment, description thereof is omitted or simplified.

The speed environment referring section 710 refers to a speed environment candidate corresponding to a preset movement speed on the basis of the present location 530 acquired by the present location acquiring section 520. The speed environment referring section 710 has a function as a predicted environment referring section having a predicted ambient environment table to store predicted ambient environment candidates corresponding to ambient environments other than an ambient sound set in advance for the hearing aid. Here, the movement speed is the speed at which the hearing aid user moves by walking or by means of transportation. For example, the movement speed is expressed by the speed per hour. The movement speed is calculated by comparing a previous location with the present location. The movement speed 0 indicates a stop state. The speed environment candidate is the most likely estimated environment in moving means at the speed. The speed environment candidate corresponds to a special environment described in the above embodiment, and is an environment candidate of, for example, a stop state, walking a bicycle, a car, an electric train, a bullet train, an airplane, or the like.

For example, when "Bicycle" is set as the speed environment candidate, it is valid in the case of bicycle riding such as commuting to work or commuting to school. During bicycle riding a wind sound increases. It is possible to reduce the wind sound to an acceptable level by providing a wind noise suppressing function to suppress the wind sound and turning on the wind noise suppressing function.

A noise or sound level included in an input signal may not be sufficiently recognized only by the speed environment 720, and proper noise suppression or sound detection may not be determined only by the speed environment 720. A combination of the speed environment 720 and a general environment included in the scheduled environment 190 based on a time described in the above embodiment or a combination of a general environment included in the regional environment 550 based on a region and a special environment as the speed environment 720 of this embodiment is input to the environment estimating section 200.

Figure 8:
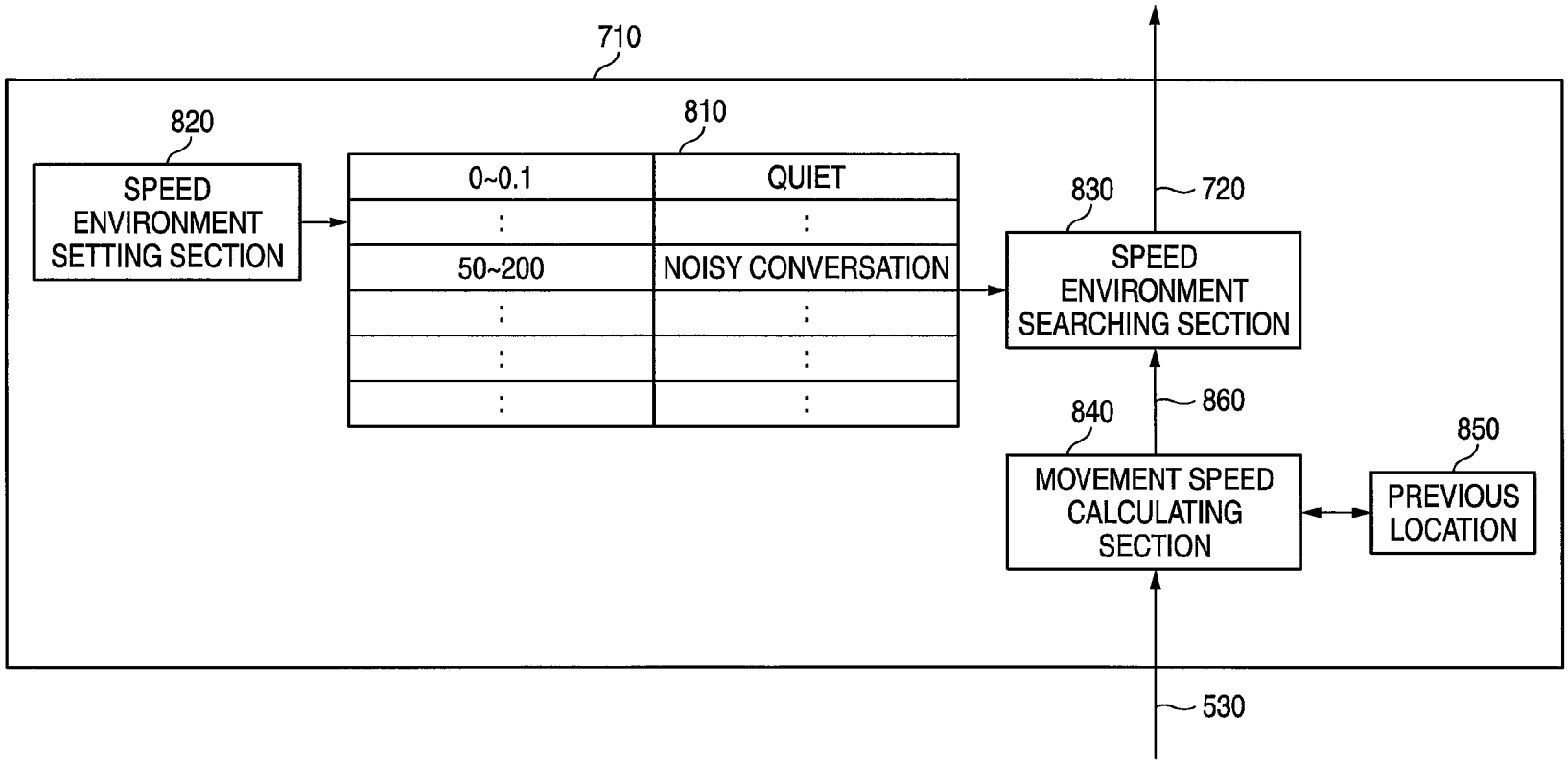
FIG. 8 is a detailed block diagram of a speed environment referring section according to the third embodiment of the present invention.

FIG. 8 is a detailed block diagram of the speed environment referring section 710 according to the third embodiment of the present invention. As illustrated in FIG. 8, the speed environment referring section 710 includes a speed environment table 810, a speed environment setting section 820, a speed environment searching section 830, and a movement speed calculating section 840. Hereinafter, the details of the speed environment referring section 710 will be described using FIG. 8.

The speed environment table 810 stores a plurality of information sets in which movement speeds are paired with speed environment information. The movement speed and the speed environment information of the speed environment table 810 are preset via the speed environment setting section 820 as shown in the speed environment table of FIG. 8. The speed environment setting section 820 has a wireless communication module to communicate with an external device. For example, there is a wireless communication protocol such as Bluetooth (registered trademark) or the like.

The speed environment setting section 820 sequentially stores the sets of movement speeds and speed environment candidates transmitted from the external device in the speed environment table 810. Alternatively, the speed environment setting section 820 is connected to a fitting device by a connection port, so that the sets of movement speeds and speed environment candidates can be received from the fitting device and can be stored in the speed environment table 810. For example, the movement speed is expressed by the speed per hour, but may be expressed by the speed per minute.

For example, when a movement speed and "Car" are set in the speed environment table 810, "Car" is output as the special environment when the movement speed reaches the speed thereof. It is desirable to store the movement speeds of the speed environment table 810 in order from slow speed to fast speed in correspondence with a search sequence of the speed environment searching section 830.

When the present location 530 from the present location acquiring section 520 is updated, the movement speed calculating section 840 calculates a movement speed 860 from a distance between the present location 530 and a previous location 850 and an update time interval and outputs the calculated movement speed 860 to the speed environment searching section 830. The movement speed 860 is calculated by first producing the distance between the two points of the present location 530 and the previous location 850 and then dividing the distance by the update time interval. The movement speed calculating section 840 stores the present location 530 as the previous location 850 after calculating the movement speed 860.

When the movement speed 860 from the movement speed calculating section 840 is updated, the speed environment searching section 830 searches the speed environment table 810 from the beginning and refers to a speed environment candidate of the movement speed corresponding to the movement speed 860. A combination of the speed environment candidate and the scheduled environment 190 or the regional environment 550 as the speed environment 720 is output to the environment estimating section 200.

In the environment estimating section 200, the estimation ambient environment 210 is determined by adjusting a similarity level on the basis of the speed environment 720 and the scheduled environment 190 or the regional environment 550.

In the third embodiment as described above, the speed environment referring section which refers to a preset speed environment on the basis of a present movement speed is provided and used to estimate ambient environments, thereby reducing the unnecessary changeover of a hearing aid process due to erroneous estimation of ambient environments, improving the accuracy of estimating ambient environments, and switching a hearing aid process without giving an uncomfortable feeling to the hearing aid user.

That is, the accuracy of estimating ambient environments is improved since the accuracy of selecting proper ambient environments is improved by adding information regarding speed environments when environment estimation is performed using a similarity level.

Fourth Embodiment

Figure 9:
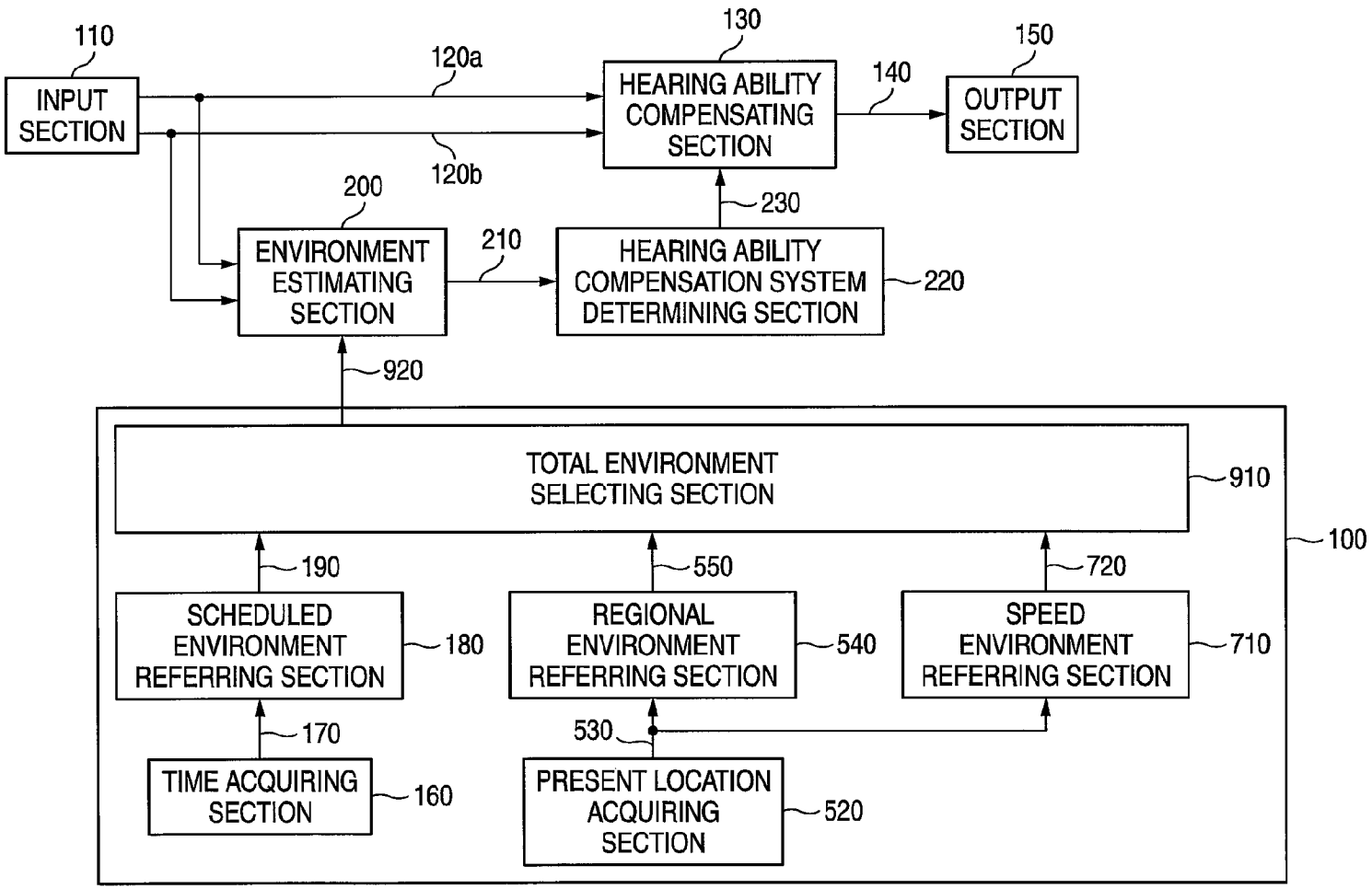
FIG. 9 is a block diagram of an environment adaptive type hearing aid according to a fourth embodiment of the present invention.

FIG. 9 is a block diagram of an environment adaptive type hearing aid according to a fourth embodiment of the present invention. As illustrated in FIG. 9, the environment adaptive type hearing aid of this embodiment includes an input section 110, a hearing ability compensating section 130, an output section 150, a scheduled environment specifying section 100, an environment estimating section 200, and a hearing ability compensation system determining section 220.

A difference from the first embodiment is that the scheduled environment specifying section 100 includes a time acquiring section 160, a scheduled environment referring section 180, a present location acquiring section 520, a regional environment referring section 540, a speed environment referring section 710, and a total environment selecting section 910 and outputs a total environment 920 to the environment estimating section 200, and an estimation environment output section 360 within the environment estimating section 200 adjusts a similarity level 350 using the total environment 920. Since the content of the total environment 920 is the same as that of the scheduled environment 190 shown in the first embodiment, the operations of the estimation environment output section 360 and the hearing ability compensation system determining section 220 are the same. The time acquiring section 160, the scheduled environment referring section 180, the present location acquiring section 520, the regional environment referring section 540, and the speed environment referring section 710 have the same operations as those shown in the first to third embodiments.

Accordingly, the total environment selecting section 910 having a different configuration will be described in detail in this embodiment. Since other elements are the same as those of the first to third embodiments, description thereof is omitted or simplified.

The total environment selecting section 910 selects one of the scheduled environments 190 referred to by the scheduled environment referring section 180 on the basis of the present time 170 acquired by the time acquiring section 160, the regional environment 550 referred to by the regional environment referring section 540 on the basis of the present location 530 acquired by the present location acquiring section 520, and a combination of the speed environment 720 referred to by the speed environment referring section 710 on the basis of the present location 530 acquired by the present location acquiring section 520 and the scheduled environment 190 or the regional environment 550, as the total environment 920.

Here, total environment candidates will be described. As in the first embodiment, the total environment candidates are "Quiet", "Conversation", "Noisy Conversation", "Office Work", "Eating", and "Commuting". Among these, "Quiet", "Conversation", "Noisy Conversation", and "Office Work" are general environments, and "Eating", "Commuting", "Concert", "Bicycle", and "Sleep" are special environments. As in the first embodiment, parameters "Noise Suppression", "Sound Detection Level", "Dish Noise Suppression", and "Electric Train Noise Suppression" are hearing ability compensation systems to be used by the hearing ability compensation system determining section 220.

The total environment selecting section 910 selects the total environment 920 from the scheduled environment, the regional environment, and the combination of the speed environment and the scheduled environment or the regional environment. Typically, selection is made from three environments by majority decision. When three environments are all different, a candidate serving as a preset standard is selected.

In the environment estimating section 200, the estimation ambient environment 210 is determined by adjusting the similarity level on the basis of the total environment 920.

In the fourth embodiment as described above, the total environment selecting section which selects an optimal environment on the basis of the scheduled environment, the regional environment, and the combination of the speed environment and the scheduled environment or the regional environment is provided and used to estimate ambient environments, thereby reducing the unnecessary changeover of a hearing aid process due to erroneous estimation of ambient environments, improving the accuracy of estimating ambient environments, and switching a hearing aid process without giving an uncomfortable feeling to the hearing aid user.

That is, the accuracy of estimating ambient environments is improved since the accuracy of selecting proper ambient environments is improved by adding information regarding a scheduled environment, a regional environment, and the combination of a speed environment and the scheduled environment or the regional environment when environment estimation is performed using a similarity level.

The total environment selecting section 910 has been constituted to select the total environment 920 from the scheduled environment, the regional environment, and the combination of the speed environment and the scheduled environment or the regional environment in the fourth embodiment, but may be constituted to select the total environment 920 from the present time 170, the present location 530, and the combination of the movement speed 860 and the present time 170 or the present location 530. When the configuration is made as described above, a larger number of environments can be identified. For example, "Quiet", "Conversation", "Noisy Conversation", and "Office Work" may be set as general environments and "Eating", "Commuting", "Concert", "Bicycle", and "Sleep" may be set as special environments by adding the environment candidates of "Concert", "Bicycle", and "Sleep" as the total environment candidates and extending the environment candidates of the first to third embodiments. The parameters of the first embodiment may be extended by adding parameters of "Acoustic Feedback Suppression", "Wind Noise Suppression", and the like as the hearing ability compensation systems to be used by the hearing ability compensation system determining section 220.

By the above-described configuration, "Acoustic Feedback Suppression" can be turned off to eliminate the false detection of acoustic feedback by identifying "Concert" from a schedule and a place. "Wind Noise Suppression" can be turned on by identifying "Bicycle" from the place and the movement speed. "Sleep" can be identified from the schedule and the movement speed. "Commuting" can be identified from the schedule, the place, and the movement speed. This improves the accuracy of selecting proper ambient environments.

Although the present invention has been described in detail with reference to specific preferred embodiments, those skilled in the art will appreciate that various changes or modifications are possible within the spirit and scope of the invention.

The present application is based on Japanese Patent Application No. 2007-169939 filed on Jun. 28, 2007, the contents of which are incorporated herein for reference.

INDUSTRIAL APPLICABILITY

An environment adaptive type hearing aid according to the present invention has a configuration which changes hearing aid characteristics by estimating an ambient environment, and is useful as a portable type hearing aid device or the like.

The invention claimed is:

1. An environment adaptive type hearing aid for generating an output sound from an ambient sound, comprising:

an input section that inputs the ambient sound;

a predicted environment referring section including a predicted ambient environment table storing a predicted ambient environment candidate corresponding to an ambient environment other than the ambient sound set in advance for the hearing aid;

an environment estimating section that estimates an ambient environment candidate of the hearing aid on the basis of the ambient sound input by the input section and estimates an estimated ambient environment on the basis of the ambient environment candidate and the predicted ambient environment candidate;

a hearing ability compensation system determining section that determines a compensation system for the hearing aid on the basis of the estimated ambient environment estimated by the environment estimating section;

a hearing ability compensating section that processes the ambient sound input by the input section on the basis of the compensation system determined by the hearing ability compensating system determining section; and an output section that outputs the ambient sound processed by the hearing ability compensating section as the output sound.

2. The environment adaptive type hearing aid according to claim 1, further comprising:

a time acquiring section that acquires a present time, wherein the predicted environment referring section stores a predetermined time band and a predicted ambient environment candidate corresponding to the predetermined time band in the predicted ambient environment table, and wherein the environment estimating section estimates the estimated ambient environment on the basis of the ambient environment candidate and the predicted ambient environment candidate corresponding to the present time acquired by the time acquiring section.

3. The environment adaptive type hearing aid according to claim 2, wherein the predicted environment referring section includes:

a movement speed calculating section for calculating a movement speed on the basis of a variation quantity of a present location of the hearing aid, wherein the predicted ambient environment table stores a predetermined speed and a predicted ambient environment candidate corresponding to the predetermined speed, and wherein the environment estimating section estimates the estimated ambient environment on the basis of the ambient environment candidate, the predicted ambient environment candidate corresponding to the present time acquired by the time acquiring section, and the predicted ambient environment candidate corresponding to the movement speed calculated by the movement speed calculating section.

4. The environment adaptive type hearing aid according to claim 2, wherein the time acquiring section acquires a present time by communicating with a device having a clock function outside the hearing aid.

5. The environment adaptive type hearing aid according to claim 1, further comprising:

a present location acquiring section that acquires a present location of the hearing aid, wherein the predicted environment referring section stores a predetermined region and a predicted ambient environment candidate corresponding to the predetermined region in the predicted ambient environment table, and wherein the environment estimating section estimates the estimated ambient environment on the basis of the ambient environment candidate and the predicted ambient environment candidate corresponding to the present location acquired by the present location acquiring section.

6. The environment adaptive type hearing aid according to claim 5, wherein the predicted environment referring section includes:

a movement speed calculating section for calculating a movement speed on the basis of a variation quantity of a present location of the hearing aid acquired by the present location acquiring section, wherein the predicted ambient environment table stores a predetermined speed and a predicted ambient environment candidate corresponding to the predetermined speed, and wherein the environment estimating section estimates the estimated ambient environment on the basis of the ambient environment candidate, the predicted ambient environment candidate corresponding to the present location acquired by the present location acquiring section, and the predicted ambient environment candidate corresponding to the movement speed calculated by the movement speed calculating section.

7. The environment adaptive type hearing aid according to claim 1, further comprising:

a time acquiring section that acquires a present time;

a present location acquiring section that acquires a present location of the hearing aid; and a predicted environment selecting section that selects at least one predicted ambient environment candidate from a plurality of predicted ambient environment candidates stored in the predicted ambient environment table, wherein the predicted environment referring section includes:

a movement speed calculating section for calculating a movement speed on the basis of a variation quantity of a present location of the hearing aid acquired by the present location acquiring section, wherein the predicted ambient environment table stores a predetermined time band and a predicted ambient environment candidate corresponding to the predetermined time band, a predetermined region and a predicted ambient environment candidate corresponding to the predetermined region, and a predetermined speed and a predicted ambient environment candidate corresponding to the predetermined speed, and wherein the environment estimating section estimates the estimated ambient environment on the basis of the ambient environment candidate and the predicted ambient environment candidate selected by the predicted environment selecting section.

8. The environment adaptive type hearing aid according to claim 7, wherein the time acquiring section acquires a present time by communicating with a device having a clock function outside the hearing aid.

9. The environment adaptive type hearing aid according to claim 1, wherein the predicted environment referring section includes:

a predicted environment setting section that sets the predicted ambient environment candidate in the predicted ambient environment table by communicating with a device outside the hearing aid; and a scheduled environment searching section that searches for a predicted ambient environment candidate corresponding to a predetermined condition from the predicted ambient environment table.

10. The environment adaptive type hearing aid according to claim 1, wherein the environment estimating section includes:

a feature quantity calculating section that calculates a feature quantity from the input signal based on the ambient sound input by the input section;

a similarity level calculating section that calculates a similarity level of each ambient environment candidate stored in an ambient environment table on the basis of the feature quantity; and an estimation environment output section that makes a comparison with a magnitude of the similarity level of each ambient environment candidate and determines the estimation estimated ambient environment.

11. The environment adaptive type hearing aid according to claim 10, wherein the estimation environment output section changes a time interval at which the estimated ambient environment is estimated on the basis of whether or not the determined estimated ambient environment matches a predicted ambient environment candidate corresponding to a predetermined condition.

12. The environment adaptive type hearing aid according to claim 10, wherein the estimation environment output section switches whether or not to consider the predicted ambient environment candidate when estimating the ambient environment.

13. The environment adaptive type hearing aid according to claim 10, wherein when a sound-signal average sound pressure level of the input signal is equal to or greater than a predetermined threshold value, the estimation environment output section estimates an ambient environment candidate having a gain which is equal to or less than a predetermined value in the hearing ability compensating section as the estimation ambient environment.

14. The environment adaptive type hearing aid according to claim 10, wherein the feature quantity calculating section extracts a sound-signal average sound pressure level of the input signal, a noise-signal average sound pressure level, a sound signal duration time, and a noise signal duration time as the feature quantities.

15. The environment adaptive type hearing aid according to claim 10, wherein the similarity level calculating section sets the similarity level by accumulating a square of a difference between a feature quantity value and a predetermined value in an ambient environment candidate stored in the ambient environment table for each feature quantity.

16. The environment adaptive type hearing aid according to claim 10, wherein the estimation environment output section assigns a weight to a similarity level of the ambient environment candidate matching the predicted ambient environment candidate.

17. The environment adaptive type hearing aid according to claim 1, wherein the hearing ability compensation system determining section outputs ON/OFF information for each hearing ability compensating function provided in the hearing aid as the hearing ability compensation system to the hearing ability compensating section.

18. The environment adaptive type hearing aid according to claim 1, wherein the hearing ability compensation system determining section outputs a weight coefficient and an increase-decrease ratio of each frequency band as the hearing ability compensation system to the hearing ability compensating section.

19. The environment adaptive type hearing aid according to claim 1, wherein the hearing ability compensating section includes:

a frequency dividing section that converts the input signal from a time domain signal into a frequency domain signal and outputs a frequency signal of each frequency band;

a power calculating section that calculates power of the frequency signal;

a gain adjusting section for adjusting a setting gain of each frequency band in correspondence with the hearing ability compensation system after acquiring a setting gain which is predetermined so as to comply with hearing ability characteristics of a hearing aid user for each frequency band from a gain table;

a gain multiplying section that outputs an adjusted signal by multiplying power of each frequency band by the adjusted gain; and a frequency synthesizing section that converts a frequency domain signal into a time domain signal on the basis of the adjusted signal of each frequency band.

20. An environment adaptive type hearing aid for generating an output sound from an ambient sound, comprising:

an input section that inputs the ambient sound;

a predicted environment referring section including a predicted ambient environment table storing a predicted ambient environment candidate corresponding to an ambient environment other than the ambient sound set in advance for the hearing aid;

an environment estimating section that estimates an ambient environment candidate of the hearing aid on the basis of the ambient sound input by the input section and estimates an estimated ambient environment on the basis of the ambient environment candidate and the predicted ambient environment candidate, the environment estimating section including:

a feature quantity calculating section that calculates a feature quantity from the input signal based on the ambient sound input by the input section;

a similarity level calculating section that calculates a similarity level of each ambient environment candidate stored in an ambient environment table on the basis of the feature quantity; and an estimation environment output section that assigns a weight to a similarity level of the ambient environment candidate matching the predicted ambient environment candidate and makes a comparison with a magnitude of the similarity level of each ambient environment candidate and determines the estimated ambient environment;

a hearing ability compensation system determining section that determines a compensation system for the hearing aid on the basis of the estimated ambient environment estimated by the environment estimating section;

a hearing ability compensating section that processes the ambient sound input by the input section on the basis of the compensation system determined by the hearing ability compensating system determining section; and an output section that outputs the ambient sound processed by the hearing ability compensating section as the output sound.

* * * * *